United States Patent [19]

Dickerson

[11] Patent Number: 4,731,028

[45] Date of Patent: Mar. 15, 1988

[54] APPARATUS FOR VISUALLY DISPLAYING AND ENHANCING SALES OF AUTOMOTIVE FLUIDS

[76] Inventor: Nathan A. Dickerson, 608 S. 5th St., Nederland, Tex. 77627

[21] Appl. No.: 31,796

[22] Filed: Mar. 30, 1987

[51] Int. Cl.[4] ..... G09F 5/00

[52] U.S. Cl. ..... 434/388

[58] Field of Search ..... 434/388, 374, 367, 369, 434/370, 365

[56] References Cited

U.S. PATENT DOCUMENTS

| | | | |
|---|---|---|---|
| 1,925,254 | 9/1933 | John | 434/388 |
| 2,086,771 | 7/1937 | Jester | 434/388 X |
| 2,133,544 | 10/1938 | Kolb | 434/388 X |
| 2,419,658 | 4/1947 | Rogers | 434/388 X |
| 2,700,228 | 1/1955 | Fainman | 434/388 |

FOREIGN PATENT DOCUMENTS

| | | | |
|---|---|---|---|
| 139267 | 11/1950 | Australia | 434/388 |

*Primary Examiner*—William H. Grieb

*Attorney, Agent, or Firm*—Donald A. Kettlestrings

[57] ABSTRACT

A display device for the sale of automotive motor oil or other automotive fluids includes a plurality of transparent containers juxtaposed with respect to each other. Motor oil or a predetermined type of automotive fluid, or its visual equivalent, is provided within predetermined ones of the containers, each of the containers having therein the fluid, or its visual equivalent, which has been subjected to automotive use for a predetermined period different from the period of use of the fluid within each of the other ones of the predetermined containers.

5 Claims, 22 Drawing Figures

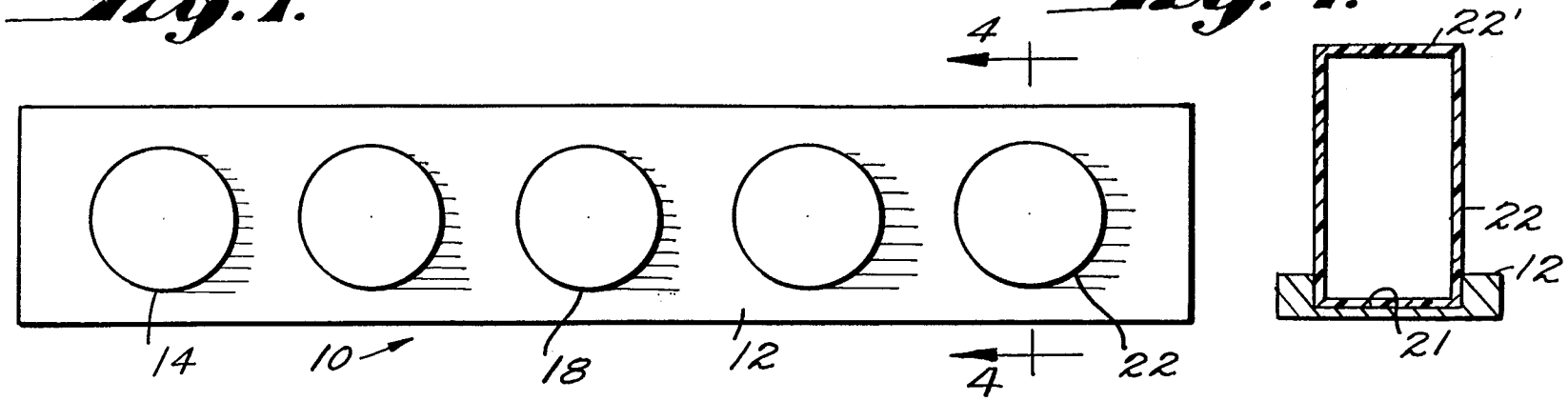
Fig. 4.
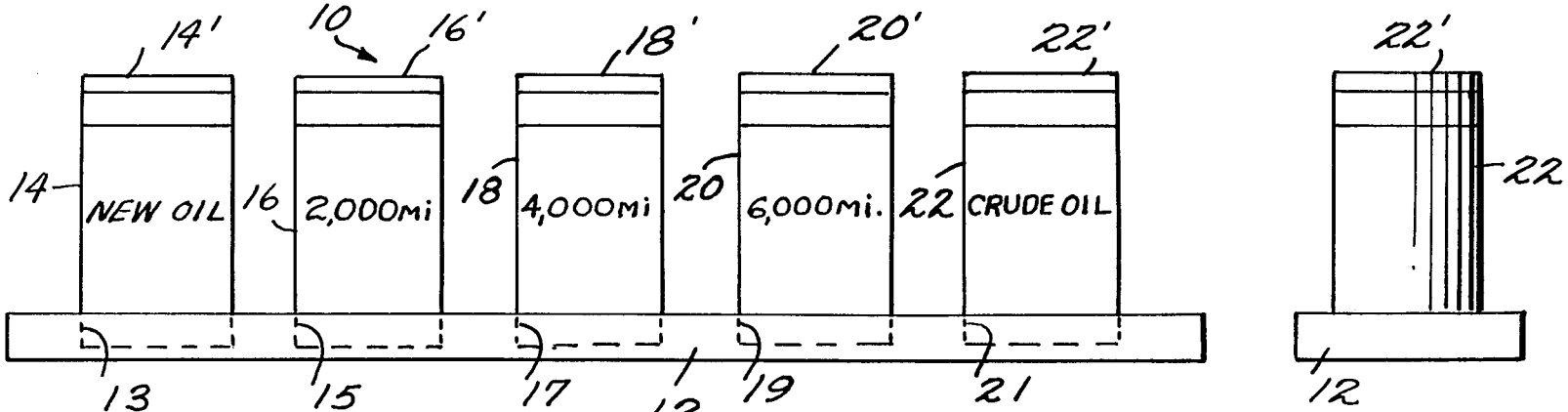
Fig. 3.
Fig. 2.
Fig. 1.

Fig. 9.
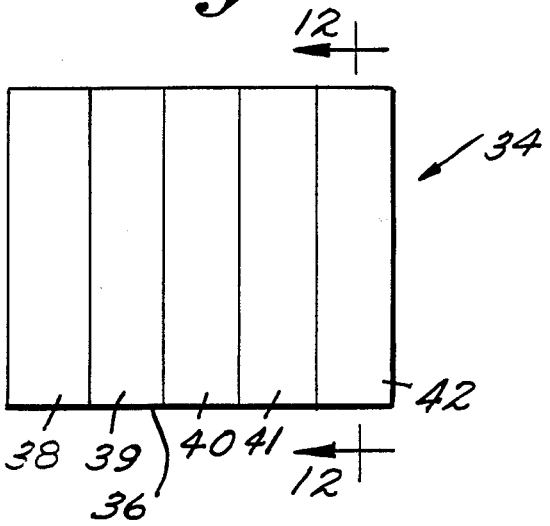
Fig. 10.
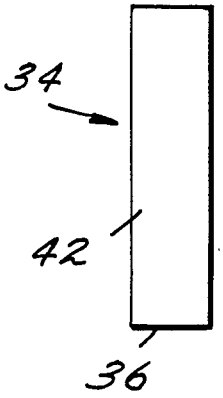
Fig. 11.
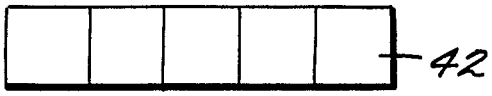
Fig. 12.
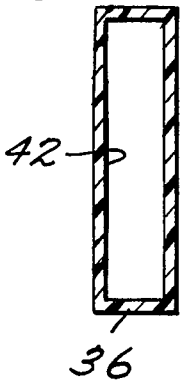
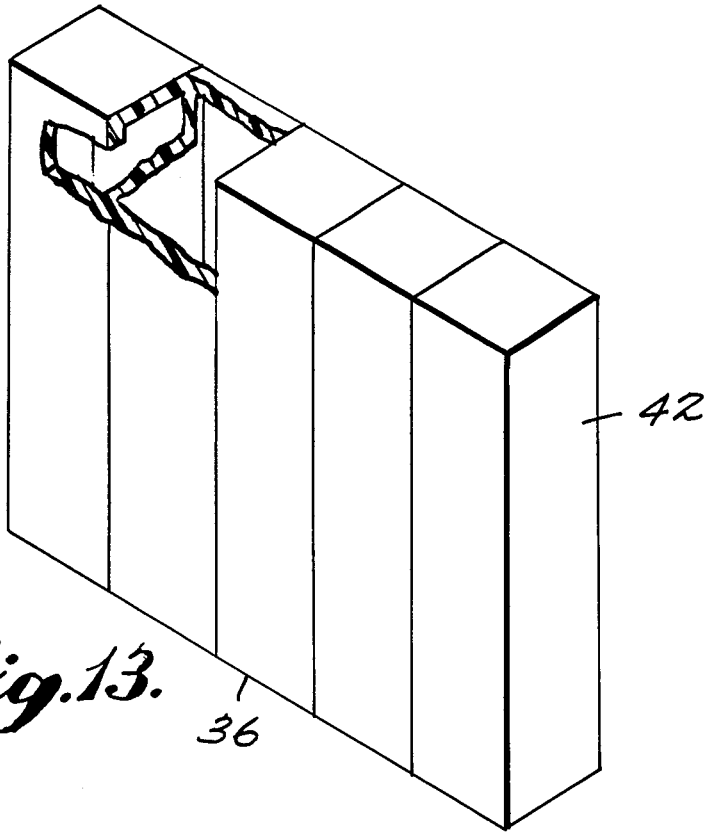
Fig. 13.

APPARATUS FOR VISUALLY DISPLAYING AND ENHANCING SALES OF AUTOMOTIVE FLUIDS

This invention relates to display devices for the sale of automotive motor oil and the like and more particularly to apparatus for visually displaying and enhancing sales of automotive fluids, such as lubricating oil, automatic transmission fluid and engine coolant.

Fresh lubricating oil has lubricating characteristics which gradually deteriorate with use. Deterioration of these lubricating characteristics occurs from exposing the oil to heat, dilution of the oil with gasoline and water, and from the addition of carbon and other debris to the oil. Generally, the lubricating value of the oil can be determined by the visual appearance of the oil. The addition of carbon and other debris to the oil and the breakdown of the oil's lubricating characteristics cause the oil to become darker in appearance. Accordingly, the color of the oil can be used as a reliable guide to determine when the lubricating oil in an engine should be replaced. Frequent changing of lubricating oil in an engine is one of the best ways to keep the engine in trouble free operating condition.

The automatic transmissions in today's automobiles require the use of fluid for their operation. As with lubricating oil, automatic transmission fluid deteriorates with use. The automatic transmission fluid is subjected to considerable heat during use, and this heat results in oxidation of the fluid. In turn, oxidation of the automatic transmission fluid reduces its operational characteristics which can cause damage to the transmission. Generally the operational characteristics of automatic transmission fluid can be determined by its visual appearance. Typically, it is red when new. As it is used and oxidizes the color turns first to a reddish brown and then to a dark brown color with no reddish tint. To protect the transmission, the automatic transmission fluid and filter should be changed periodically, and the fluid color can be used as a reliable guide to determine when the fluid should be changed.

Automotive engine coolant/antifreeze must also be periodically changed to maintain the best cooling characteristics. Failure to periodically change engine coolant/antifreeze can result in corroded radiaters and overheated engines. The visual appearance of engine coolant/antifreeze can also be used to determine when the coolant/antifreeze should be changed.

Accordingly, it is an object of the present invention to provide apparatus for enabling a motorist to quickly and easily determine whether his lubricating oil, automatic transmission fluid and engine coolant/antifreeze should be replaced.

Another object is to provide apparatus for visually displaying automotive fluids, or their visual equivalents, at various stages of usage so that motorists can compare the fluids from their vehicle with the displayed fluids for the purpose of determining whether the motorist's fluids should be replaced.

A further object of the invention is the provision of apparatus for visually displaying and enhancing sales of automotive fluids, such as lubricating oil, automatic transmission fluid and engine coolant/antifreeze.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a plurality of transparent containers juxtaposed with respect to each other in a predetermined manner; and a predetermined type of automotive fluid, or its visual equivalent, is provided within predetermined ones of the containers, each of the predetermined containers having therein the fluid, or its visual equivalent, which has been subjected to automotive use for a predetermined period different from the period of use of the fluid within each of the other ones of the predetermined containers.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

FIG. 1 is a top plan view of one embodiment of the invention;

FIG. 2 is a front elevation view of the embodiment shown in FIG. 1;

FIG. 3 is an end elevation view of the embodiment shown in FIG. 1;

FIG. 4 is a sectional view taken along the line 4—4 in FIG. 1 and looking in the direction of the arrows;

FIG. 9 is a front elevation view of another embodiment of the invention;

FIG. 10 is an end elevation view of the embodiment shown in FIG. 9;

FIG. 11 is a top plan view of the embodiment shown in FIG. 9;

FIG. 12 is a cross-sectional view taken along the line 12—12 in FIG. 9 and looking in the direction of the arrows;

FIG. 13 is a fragmentary perspective view of the embodiment shown in FIG. 9;

Figure 5:
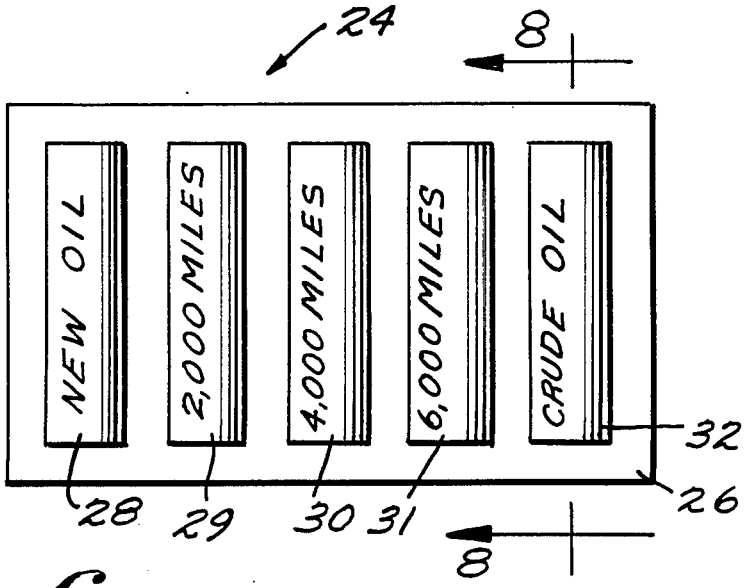
FIG. 5 is a top elevation view of another invention embodiment.
Figure 6:
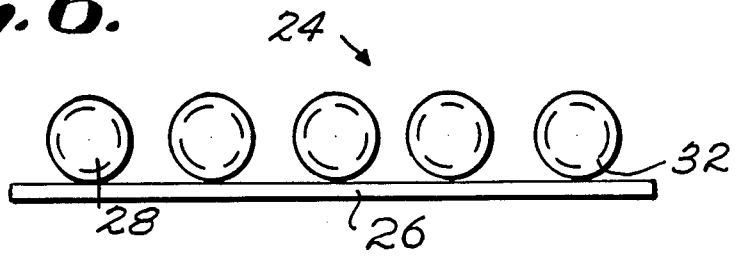
FIG. 6 is a front elevation view of the embodiment shown in FIG. 5.
Figure 7:
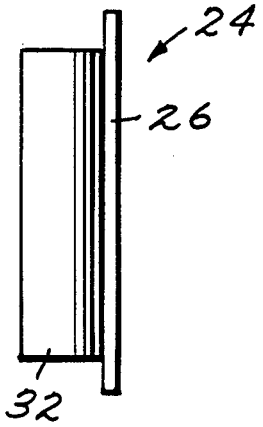
FIG. 7 is an end elevation view of the embodiment shown in FIG. 5.
Figure 8:
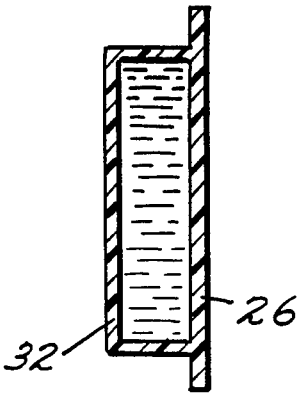
FIG. 8 is a cross-section taken along the line 8—8 in FIG. 5 and looking in the direction of the arrows.
Figure 14:
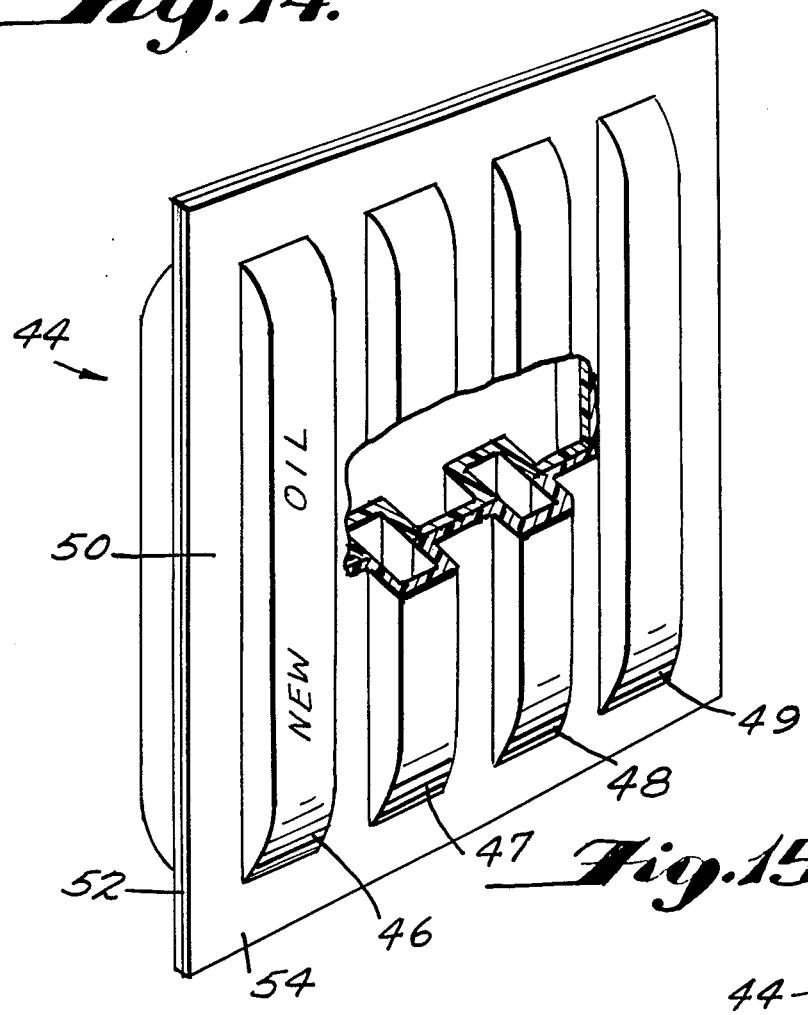
FIG. 14 is a fragmentary perspective view of another embodiment of the invention.
Figure 15:
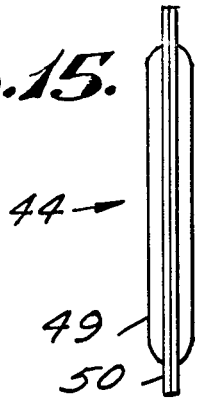
FIG. 15 is an end elevation view of the embodiment shown in FIG. 14.
Figure 16:
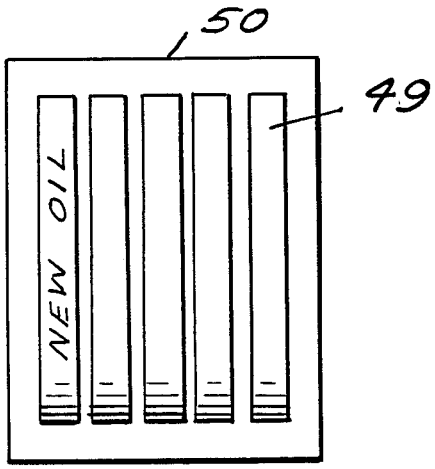
FIG. 16 is a front elevation view of the embodiment shown in FIG. 14.
Figure 17:
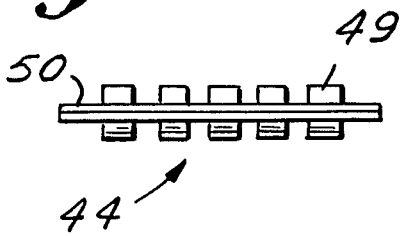
FIG. 17 is a top plan view of the embodiment shown in FIG. 14.
Figure 18:
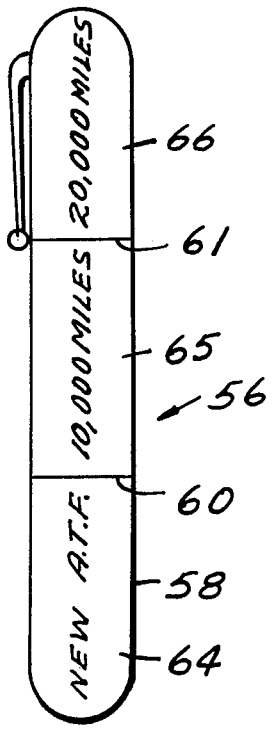
FIG. 18 is a side elevation view of another embodiment of the invention.
Figure 19:
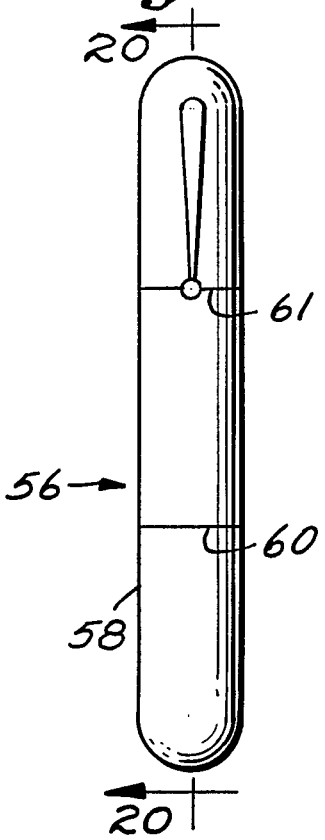
FIG. 19 is a front elevation view of the embodiment shown in FIG. 18.
Figure 20:
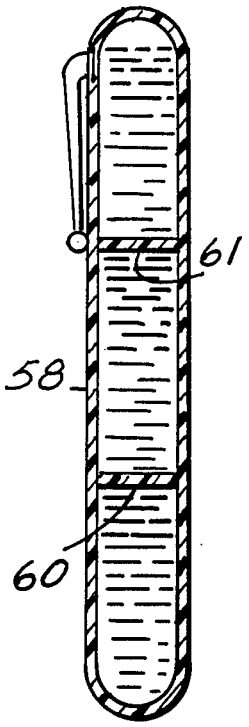
FIG. 20 is a cross-sectional view taken along the line 20—20 in FIG. 19 and looking in the direction of the arrows.
Figure 21:
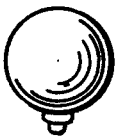
FIG. 21 is a top plan view of the embodiment shown in FIG. 18.

With reference now to FIGS. 1-4 of the drawings, wherein like reference characters designate like or corresponding parts throughout the several views, there is shown a first embodiment of apparatus 10 for visually displaying and enhancing sales of automotive fluids such as lubricating oil, automatic transmission fluid and engine coolant/antifreeze.

Apparatus 10 includes base member means 12 for placement onto a separate supporting surface (not shown) during normal use of apparatus 10. A plurality of transparent containers 14, 16, 18, 20 and 22 are mounted in a conventional manner on base member means 12, and the containers are juxtaposed with respect to each other in a predetermined manner. As shown in FIGS. 1-4 base member means 12 is provided with a plurality of depressions 13, 15, 17, 19 and 21 of predetermined shapes and configurations for receiving respective ones of containers 14, 16, 18, 20 and 22. The containers can be friction-fit into the depressions, or adhesive may be used to hold the containers within the depressions.

A preferred arrangement for the containers is illustrated in FIGS. 1-4 wherein the containers are in alignment with each other. However, it should be understood that various position arrangements could be provided for the containers in accordance with this invention. Likewise, although base member means 12 is illustrated as an elongated rectangle, it should be understood that the shape and configuration of base member means 12 could be different from that illustrated.

In accordance with the invention, a predetermined type of automotive fluid, or its visual equivalent, is located within predetermined ones of containers 14-22. Each of the predetermined containers has therein fluid, or its visual equivalent, which has been subjected to automotive use for a predetermined period different from the period of use of the fluid within each of the other ones of the predetermined containers. By visual equivalent it is meant that paint on the interior of each container or another fluid or solid material replaces the automotive fluid in each container and the replacement paint or material has a color substantially identical to the color of the automotive fluid it is intended to simulate.

As best illustrated in FIG. 2, for example, new lubricating oil can be provided within container 14. Second container 16 may have a sample of lubricating oil that has been used for two thousand miles or approximately two months of operating time. This is the best time to change the oil to ensure trouble-free engine usage. Third container 18 may contain oil which has been used for four thousand miles. Its oil will be darker in color as a result of the addition of carbon and other debris to the oil and because of the exposure of the oil to heat. Container 20 may contain lubricating oil that has been used for six thousand miles. This oil is much darker and appears to be thicker in consistency. It contains more carbon particles and debris from the engine's combustion chamber which restricts the oil's ability to lubricate properly. Container 22 may contain crude oil which is extremely dark in color and which can be used for the purpose of comparison with the oil in the other containers.

Each container 14-22 is provided with a separate cover 14'-22', respectively, and the covers can be removable to permit the oil or other material within the containers to be removed and/or replaced.

Apparatus 10 will increase lubricating oil sales at sales outlets. It shows the consumer the condition of the lubricating oil in the consumer's engine in a vivid and graphic manner. By noting the odometer reading and the date of the last oil change, the consumer can determine if and when an oil change should be performed on his vehicle. Alternatively, the consumer can compare the condition of the oil on the dip stick of his vehicle with the oil within apparatus 10. The consumer can easily see the color condition of his motor oil, and can determine whether the oil in his engine should be replaced.

An alternative embodiment 24 is illustrated in FIGS. 5-8 wherein like reference characters designate like or corresponding parts throughout the several views. Base member means 26 is provided for placement onto a separate supporting surface (not shown) during normal use of apparatus 24. A plurality of transparent containers 28-32 are mounted on base member means 26 in juxtaposed position with respect to each other in a predetermined manner. As in the previous embodiment, oil or other automotive fluid, or its visual equivalent, in varying stages of usage is provided within respective ones of containers 28-32.

Another embodiment 34 of the invention is illustrated in FIGS. 9-13. Embodiment 34 includes base member means 36 for placement onto a separate supporting surface (not shown) during normal use of apparatus 34. A plurality of transparent containers 38-42 are mounted on base member means 36 in juxtaposed position with respect to each other in a predetermined manner. As in the previous embodiments, motor oil, automatic transmission fluid or engine coolant/antifreeze, or their visual equivalents, in varying stages of usage is located within each of containers 38-42.

A fourth embodiment 44 of the invention is illustrated in FIGS. 14-17. A plurality of transparent containers 46-49 are juxtaposed with respect to each other in a predetermined manner, and a transparent material 50, such as plastic, surrounds containers 46-49. The containers are embedded within transparent material 50. Transparent material or plastic 50 may be formed from a single unit of plastic which has been molded into position around containers 46-49, or material 50 may be comprised of two separate plastic sheets 52, 54 which together cover and surround containers 46-49. Each of sheets 52, 54 is fused or adhered to the other around the perimeters of the sheets, as illustrated in FIGS. 14-17.

As in the previous embodiments, each of containers 46-49 contains an automotive fluid, such as lubricating oil, automatic transmission fluid or engine coolant/antifreeze, or their visual equivalents, in varying stages of use.

Figure 22:
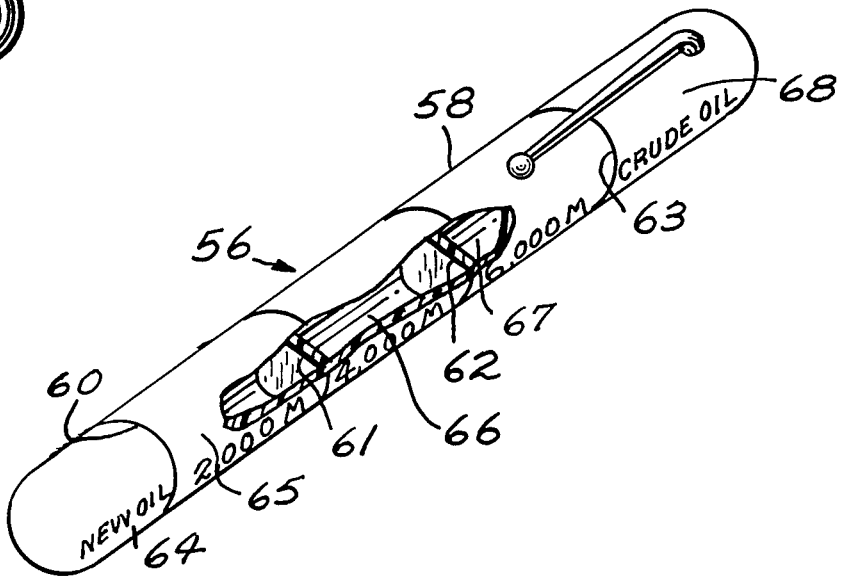
FIG. 22 is a fragmentary perspective view of an expanded embodiment of the apparatus shown in FIG. 18.

A fifth embodiment 56 of the apparatus is illustrated in FIGS. 18-22. This embodiment is small and compact in size and shape so that it can easily be carried in the pocket of a sales person. Embodiment 56 can be conveniently used by a sales person outside of the sales office as he is servicing customers' vehicles. Apparatus 56 includes a transparent container 58, of plastic or other suitable material, and a plurality of divider elements 60, 61 are positioned within container 58 and cooperate with the container to form a plurality of discrete chambers 64, 65, 66 within the container. As in the previous embodiments, each of chambers 64, 65, 66 contains an automotive fluid, such as engine oil, automatic transmission fluid or engine coolant/antifreeze, or their visual equivalent, which is in a different stage of use. The expanded embodiment shown in FIG. 22 shows the addition of divider elements 62, 63 and additional chambers 67, 68.

The invention in its broader aspects is not limited to the specific details shown and described, and departures may be made from such details without departing from the principles of the invention and without sacrificing its chief advantages.

What is claimed is:

1. Apparatus for visually displaying and enhancing sales of automotive fluids, said apparatus comprising:

base member means for placement onto a separate supporting surface during normal use of said apparatus;

a plurality of three or more transparent containers mounted on said base member means and juxtaposed with respect to each other in a predetermined manner; and a predetermined type of automotive fluid, or its visual equivalent, within predetermined ones of said containers, each of said predetermined containers having therein said fluid, or its visual equivalent, which has been subjected to automotive use for a predetermined period different from the period of use of said fluid within each of the other ones of said predetermined containers.

2. Apparatus as in claim 1 further including a separate cover positioned over and enclosing each of said containers.

3. Apparatus for visually displaying and enhancing sales of automotive fluids, said apparatus comprising:

a plurality of transparent containers juxtaposed with respect to each other in a predetermined manner;

transparent material surrounding said containers and embedding said containers within said transparent material; and a predetermined type of automotive fluid, or its visual equivalent, within predetermined ones of said containers, each of said predetermined containers having therein said fluid, or its visual equivalent, which has been subjected to automotive use for a predetermined period different from the period of use of said fluid within each of the other ones of said predetermined containers.

4. Apparatus as in claim 3 wherein said transparent material is plastic.

5. Apparatus for visually displaying and enhancing sales of automotive fluids, said apparatus comprising:

a transparent container;

a plurality of divider elements within said container cooperating with said container to form a plurality of discrete chambers within said container; and a predetermined type of automotive fluid, or its visual equivalent, within predetermined ones of said chambers, each of said predetermined chambers having therein said fluid, or its visual equivalent, which has been subjected to automotive use for a predetermined period different from the period of use of said fluid within each of the other ones of said predetermined chambers.

* * * * *